United States Patent [19]

Steffen

[11] 4,316,603

[45] Feb. 23, 1982

[54] STOCKLINE ARMOR CONSTRUCTION FOR BLAST FURNACES

[75] Inventor: Howard W. Steffen, Peters Township, Washington County, Pa.

[73] Assignee: United States Steel Corporation, Pittsburgh, Pa.

[21] Appl. No.: 187,293

[22] Filed: Sep. 15, 1980

Related U.S. Application Data

[63] Continuation of Ser. No. 81,725, Oct. 4, 1979, abandoned.

[51] Int. Cl.[3] ..... C21B 7/08

[52] U.S. Cl. ..... 266/282; 266/197; 110/336

[58] Field of Search ..... 266/197, 282; 110/336

[56] References Cited

U.S. PATENT DOCUMENTS 3,250,523 5/1966 Corbin et al. ..... 266/282
3,416,780 12/1968 Hanna ..... 266/282

FOREIGN PATENT DOCUMENTS 602248 2/1960 Italy ..... 266/282

*Primary Examiner*—M. J. Andrews
*Attorney, Agent, or Firm*—William F. Riesmeyer, III

[57] ABSTRACT

A stockline armor construction for blast furnaces in which the armor plates are anchored positively to the inside face of the furnace shell. The anchoring means includes brackets fixed to the shell to be engaged by tongues on the plates. The tongues have tabs which abut the shell to support the plates even through the refractory lining of the furnace is eroded away completely.

4 Claims, 3 Drawing Figures

STOCKLINE ARMOR CONSTRUCTION FOR BLAST FURNACES

This is a continuation of application Ser. No. 81,725, filed Oct. 4, 1979 now abandoned.

This invention relates to improved stockline armor construction for blast furnaces.

The stack of a conventional blast furnace includes a metal shell and a lining of refractory brickwork. When material is charged to the furnace, it tends to strike the lining in an area near the top. Customarily, the vulnerable area of the lining is protected by stockline armor. The usual stockline armor includes rows of metal plates which are placed between courses of the brickwork and have depending flanges overlying the otherwise exposed faces of the bricks. Reference can be made to Corbin et al U.S. Pat. No. 3,250,523 or Hanna U.S. Pat. No. 3,416,780, both of common ownership, for exemplary showings.

The individual plates of the stockline armor rest on the brickwork for support, although it is known to anchor them to metal bars embedded in an intermediate lining of castable refractory between the brickwork and shell, as shown, for example, in the aforementioned Hanna patent. If the brickwork erodes away, the armor plates either fall into the furnace or hang loosely from the anchor means, where they afford no protection to any remaining refractory or to the shell.

An object of my invention is to provide an improved stockline armor construction in which the individual plates are anchored to the furnace shell and are positively supported even though the brickwork erodes away.

A further object is to provide improved stockline armor plates which have supporting tabs engageable with anchor means fixed to the furnace shell and also adapted to abut the shell directly for supporting the plates even if the refractory erodes away completely.

Figure 1:
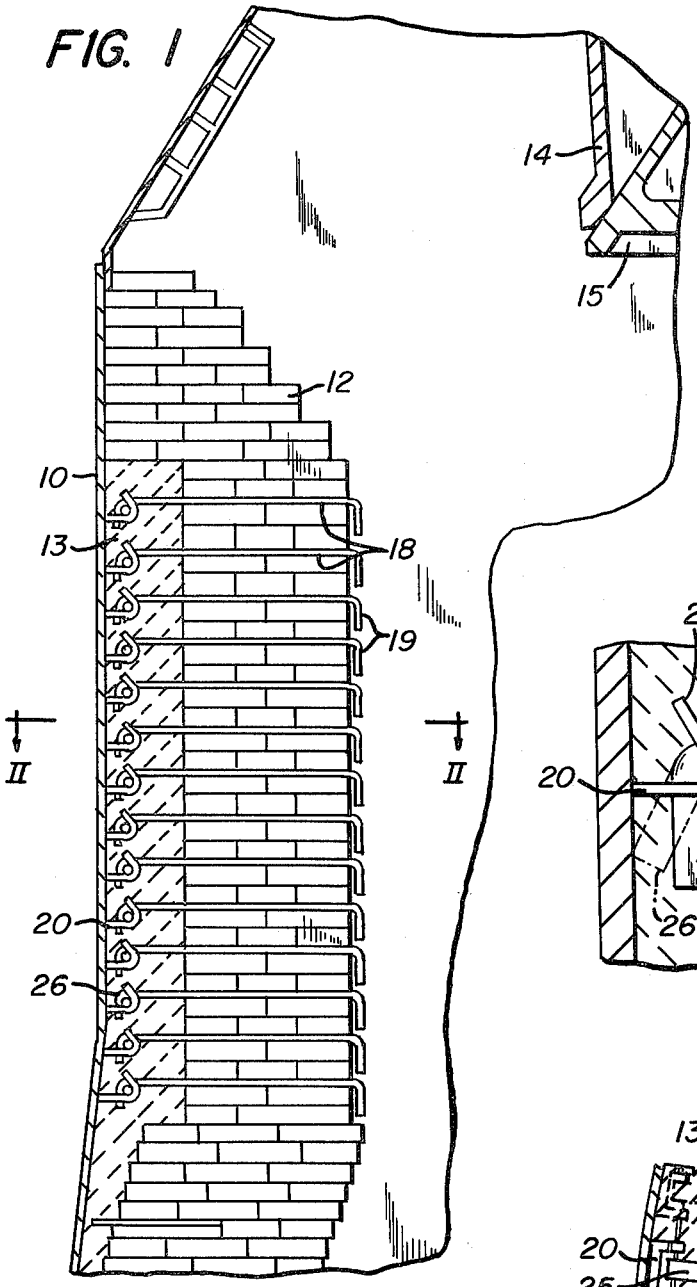
FIG. 1 is a vertical sectional view of a portion of a blast furnace equipped with my improved stockline armor construction.

FIG. 1 shows a portion of a blast furnace which includes a metal shell 10, an inner lining 12 of refractory brickwork, and an intermediate lining 13 of castable refractory between the shell and the inner lining. The furnace illustrated has a hopper 14 for receiving material to be charged to the furnace and a large bell 15 which opens to release the material from the hopper to the furnace. The trajectory of the material is such that the material tends to strike the furnace lining in an area near the top. The vulnerable area of the brickwork susceptible to being struck is protected by stockline armor which includes a plurality of rows of metal plates 18, one such row being placed over each course of brickwork. The plates have the usual integral depending flanges 19 which overlie the otherwise exposed faces of the bricks. The furnace may be of conventional construction apart from the stockline armor, and hence is not shown or described in any more detail.

Figure 3:
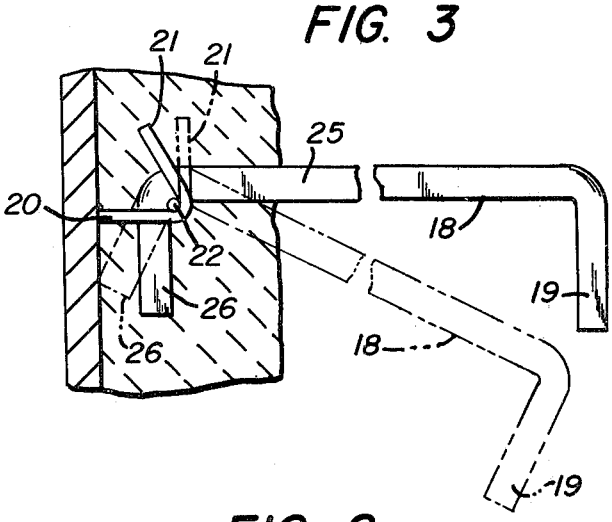
FIG. 3 is a side elevational view on a still larger scale of the anchor means.
Figure 2:
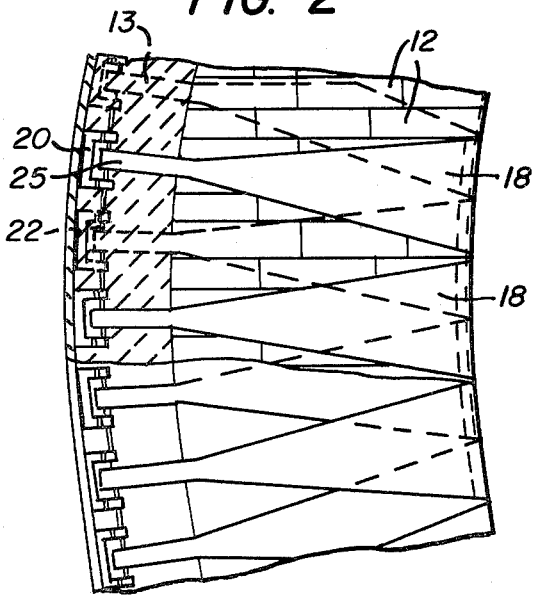
FIG. 2 is a horizontal section on a larger scale on line II—II of FIG. 1.

In accordance with my invention, before installing the inner and intermediate linings 12 and 13, I weld or otherwise fix rows of circumferentially spaced brackets 20 to the inside face of the shell 10. Each row of brackets lies at a level approximately even with the top of a course of brickwork when the inner lining 12 is in place. Each bracket is U-shaped in plan (FIG. 2). The arms of the U extend horizontally, but have segments 21 which initially extend vertically, as shown in phantom lines in FIG. 3. I place rods 22 on the brackets of each row and bend the segments 21 downwardly to hold the rods in place, as shown in solid lines in FIG. 3.

Each plate 18 has a relatively narrow integral tongue 25 at the end opposite its flange 19. The end of the tongue extends downwardly forming a tap 26 which I insert between the arms of one of the brackets 20 over the rod 22. I install each plate in this fashion as the course of brickwork immediately beneath is laid, and also install the castable intermediate lining 13 over the brackets and tongues.

The brackets 20 and rod 22 form anchoring means which positively anchor each plate 18 to the shell 10. Thus the plates remain supported by the shell as the brickwork 12 erodes away during operation of the furnace. In the extreme condition when the brickwork 12 and castable intermediate lining 13 are completely eroded away, the lower end of the tab 26 abuts the surface of the shell 10, as shown in phantom lines in FIG. 3, whereby the tab holds the plate in a position which protects the shell, and the plate does not fall into the furnace.

From the foregoing description, it is seen that my invention affords a simple construction of stockline armor which positively supports the armor plates and assures that they do not fall into the furnace or hang loosely from the anchoring means. The plates remain in a position effective for protecting the shell even though both refractory linings are eroded away completely.

I claim:

1. In a blast furnace, said furnace including a shell, courses of brickwork forming a lining within said shell, and stockline armor apparatus for protecting said brickwork, said apparatus including rows of plates adapted to be placed over each course of brickwork in an area susceptible to being struck by material charged to the furnace, said plates extending longitudinally in a radial direction inward from said shell and having flanges for overlying the otherwise exposed face of said brickwork, and anchoring means for holding said plates in position in the furnace, said anchoring means permitting some vertical movement of the plates as well as pivotal movement about a horizontal axis, the improvement in said apparatus which comprises:

said plates each having a downward depending tongue adjacent the end thereof near said shell, said tongue being of length sufficient to abut said shell when said refractory beneath the plates erodes away and said plates therefore start to pivot downward about said horizontal axis, so as to limit the extent of pivotal movement of said plates and thus protect the furnace shell from overheating.

2. The apparatus of claim 1 wherein said anchoring means is adapted to be attached to the shell of the furnace.

3. The apparatus of claim 1 in which said anchoring means includes rows of circumferentially spaced brackets fixed to the inside face of said shell, and horizontally extending support means mounted on said brackets, said tongues on said plates engaging said support means to anchor said plates to said shell.

4. The apparatus of claim 3 in which said brackets are U-shaped in plan and said support means includes a rod placed on said brackets.

* * * * *